US008430028B2

(12) United States Patent
Biggs et al.

(10) Patent No.: US 8,430,028 B2
(45) Date of Patent: Apr. 30, 2013

(54) SHOCK DAMPENED EXPLOSIVE INITIATOR ASSEMBLY AND METHOD FOR DAMPENING SHOCK WITHIN A DELIVERY VEHICLE

(75) Inventors: Bradley Biggs, Corona, AZ (US); Timothy B. Bonbrake, Tuscon, AZ (US); George Darryl Budy, Tuscon, AZ (US)

(73) Assignee: Raytheon Company, Waltham, MA (US)

( * ) Notice: Subject to any disclaimer, the term of this patent is extended or adjusted under 35 U.S.C. 154(b) by 53 days.

(21) Appl. No.: 13/076,684

(22) Filed: Mar. 31, 2011

(65) Prior Publication Data

US 2012/0227607 A1 Sep. 13, 2012

Related U.S. Application Data

(60) Provisional application No. 61/369,571, filed on Jul. 30, 2010.

(51) Int. Cl.
*F42B 3/10* (2006.01)

(52) U.S. Cl.
USPC ..... 102/202.12; 102/202.5

(58) Field of Classification Search ... 102/202.5–202.14
See application file for complete search history.

(56) References Cited

U.S. PATENT DOCUMENTS

| | | | | |
|---|---|---|---|---|
| 3,231,255 | A | 1/1966 | Olson | |
| 5,216,325 | A * | 6/1993 | Patel et al. | 313/595 |
| 5,573,428 | A * | 11/1996 | Biggs et al. | 439/566 |
| 7,240,617 | B1 * | 7/2007 | Bonbrake et al. | 102/221 |
| 7,549,374 | B2 * | 6/2009 | Schwantes et al. | 102/275.9 |
| 7,552,682 | B2 * | 6/2009 | Schwantes et al. | 102/275.9 |
| 7,802,518 | B2 * | 9/2010 | Schwantes et al. | 102/275.9 |
| 7,814,834 | B2 * | 10/2010 | Schwantes et al. | 102/275.9 |
| 7,971,533 | B1 * | 7/2011 | Berlin et al. | 102/275.9 |
| 2006/0016360 | A1 | 1/2006 | Eches et al. | |
| 2008/0148984 | A1 | 6/2008 | Schwantes et al. | |
| 2011/0235465 | A1 * | 9/2011 | Bostick et al. | 367/99 |

FOREIGN PATENT DOCUMENTS

WO WO-2012/039739 A1 3/2010

OTHER PUBLICATIONS

"International Application Serial No. PCT/US2011/00976, International Search Report mailed Mar. 2, 2012", 2 pgs.
"International Application Serial No. PCT/US2011/00976, Written Opinion mailed Mar. 2, 2010", 7 pgs.

* cited by examiner

*Primary Examiner* — Michael David
(74) *Attorney, Agent, or Firm* — Schwegman Lundberg & Woessner, P.A.

(57) ABSTRACT

Some embodiments pertain to an initiator support assembly that includes a casing and one or more initiator leads extending from the casing. The transmission of current through the initiator leads detonates an explosive charge within the casing. The casing includes a flange and a dampening member attached to the flange. The dampening member is between the flange and a structure where the initiator support assembly is mounted. The dampening member dampens shock that would otherwise be transferred from the structure to the initiator support assembly. In another example embodiment, at least a portion of the casing is formed of an interior wall, a dampening layer covering at least a portion of the interior wall and an exterior wall. The dampening layer dampens shock to the initiator support assembly that would otherwise be transferred from a structure to the initiator support assembly when the exterior wall is mounted to the structure.

6 Claims, 6 Drawing Sheets

SHOCK DAMPENED EXPLOSIVE INITIATOR ASSEMBLY AND METHOD FOR DAMPENING SHOCK WITHIN A DELIVERY VEHICLE

CLAIM OF PRIORITY

This application claims the benefit of priority under 35 U.S.C. §119(e) to U.S. Provisional Application Ser. No. 61/369,571, filed Jul. 30, 2010, the disclosure of which is incorporated by reference herein in its entirety.

TECHNICAL FIELD

Embodiments pertain to an explosive initiator assembly, and more particularly to a shock dampened explosive initiator assembly and a method for reducing shock delivered to an explosive initiator assembly.

BACKGROUND

Explosive payloads are delivered in a variety of vehicles including missiles, gun-fired projectiles, bombs and the like. The explosive initiator within such vehicles must survive the gun-firing environments that include acceleration, balloting and muzzle exit deceleration.

Many of the desired targets are located within hardened structures that have impact and explosive resistant walls or structures (e.g., overlying rock and/or concrete). Successful delivery of the payload to the target often requires penetration of the payload through the protective structure followed by detonation within or near the target.

Impact and penetration of the delivery vehicle and explosive payload transmits significant shock loads to the sensitive materials within the vehicle and may cause significant acceleration, deceleration, rebounding of materials, and movement of materials relative to other sensitive components (e.g., rapid lateral deflection during impact/penetration). One example of rapid lateral deflection during impact/penetration is sometimes referred to as tail slap. The initiator that is used to detonate the explosive payload can be sensitive to these types of things.

As an example, any shock loading and rapid deceleration of the delivery vehicle may transmit unwanted stress to the explosive charge within the initiator. The stress may cause the explosive charge to crack and correspondingly prevent proper initiation of the charge, thereby resulting in the failure of the explosive payload to detonate.

SUMMARY

Some embodiments pertain to an initiator support assembly which includes a casing that has a diaphragm. The initiator support assembly further includes an explosive charge positioned within the casing. The diaphragm dampens shock to the initiator support assembly when the diaphragm is mounted against a structure (e.g. a structure on a delivery vehicle).

Other embodiments pertain to an initiator support assembly which includes a casing that has a flange and an explosive charge positioned within the casing. The initiator support assembly further includes a dampening member attached to the flange such that the dampening member is between the flange and a structure where the initiator support assembly is mounted. The dampening member dampens shock that is generated on the initiator support assembly when the flange is mounted against a structure (e.g. a structure on a delivery vehicle).

Still other embodiments pertain to an initiator support assembly which includes a casing and an explosive charge positioned within the casing. At least a portion of the casing is formed of an interior wall and a dampening layer that covers at least a portion of the interior wall. The casing further includes an exterior wall such that the dampening layer dampens shock to the initiator support assembly when the exterior wall is mounted against a structure (e.g. a structure on a delivery vehicle).

Some embodiments pertain to a method for dampening shock delivered to an initiator support assembly within a delivery vehicle. The method includes providing an initiator support assembly which includes a casing that has a diaphragm mounted against a structure in the delivery vehicle. The initiator support assembly further includes an explosive charge within the casing. The method further includes directing the delivery vehicle toward a target and impacting the delivery vehicle with the target. The method further includes using the diaphragm to dampen shock delivered to the initiator support assembly when the delivery vehicle impacts the target.

Other embodiments pertain to a method for dampening shock delivered to an initiator support assembly within a delivery vehicle where the method includes providing an initiator support assembly that includes a casing having a flange and an explosive charge within the casing. The initiator support assembly further includes a dampening member attached to the flange such that the dampening member is between the flange and a structure where the initiator support assembly is mounted. The method further includes directing the delivery vehicle toward a target and impacting the delivery vehicle with the target. The method further includes using the dampening member to dampen shock that is delivered to the initiator support assembly when the delivery vehicle impacts the target.

Still other embodiments pertain to a method for dampening shock delivered to an initiator support assembly within a delivery vehicle where the method includes providing an initiator support assembly that has a casing and an explosive charge within the casing. At least a portion of the casing is formed of an interior wall and a dampening layer covers at least a portion of the interior wall. The casing further includes an exterior wall that is mounted against a structure in the delivery vehicle. The method further includes directing the delivery vehicle toward a target and impacting the delivery vehicle with the target. The method further includes using the dampening layer to dampen shock delivered to the initiator support assembly when the delivery vehicle impacts the target.

Some embodiments pertain to an initiator support assembly within a delivery vehicle where the initiator support assembly is configured to (i) impact the delivery vehicle with the target; and (ii) use a diaphragm which forms part of a casing that includes an explosive to dampen shock delivered to the initiator support assembly when the delivery vehicle impacts the target.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow surfaces, reinforcing structures, explosives and the like, which may carry out a variety of functions. In addition, the present subject matter may be practiced in conjunction with any number of devices, and the systems described are merely exemplary applications.

Figure 1:
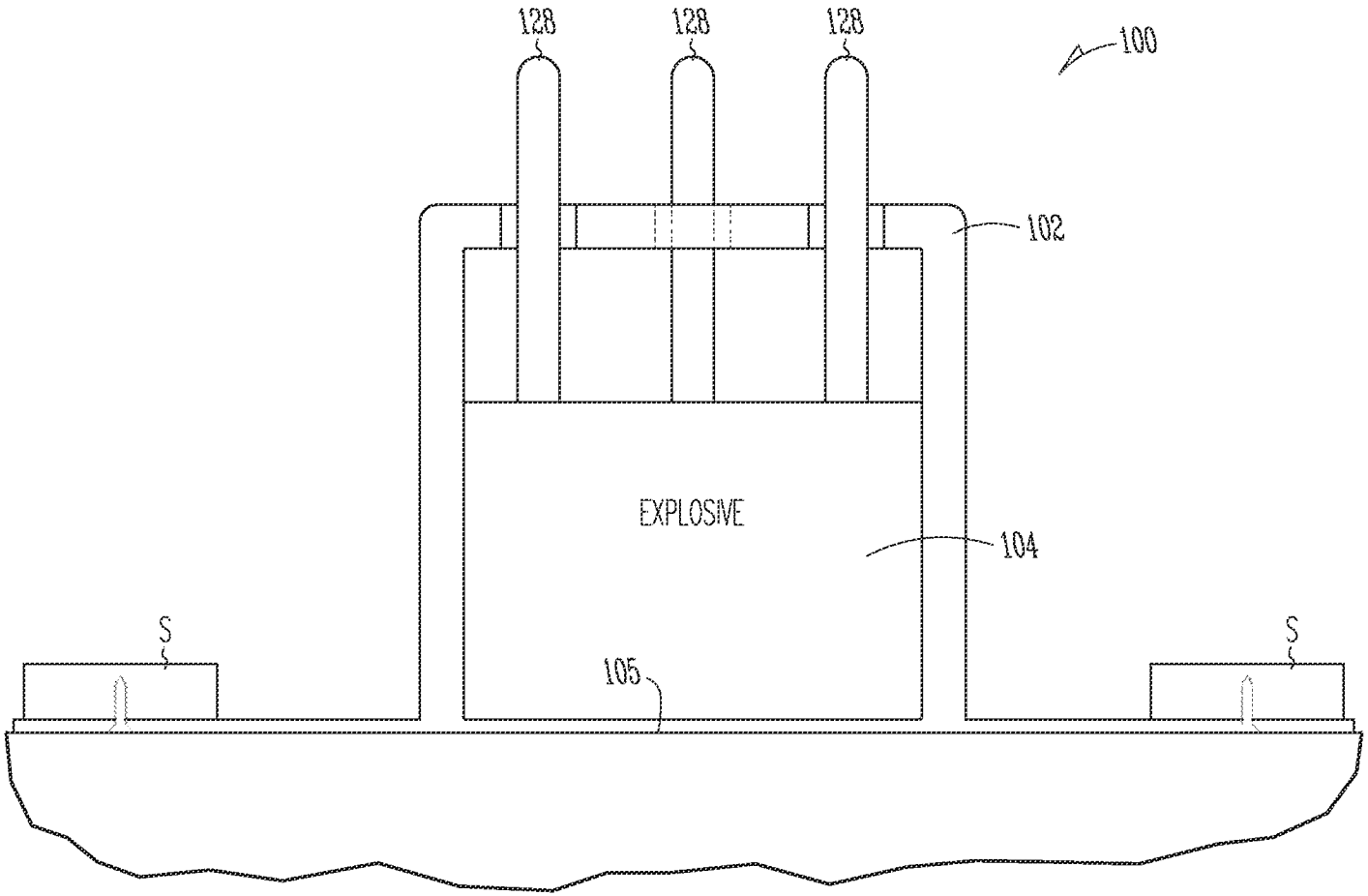
FIG. 1 is a schematic cross section view of an initiator support assembly in accordance with one example embodiment.

FIG. 1 shows an example initiator support assembly 100 for use in an explosive payload delivery device, including but not limited to, a gun-fired projectile, missile, bomb and the like. The initiator support assembly 100 includes a casing 102 and one or more initiator leads 128 extending from the casing 102. In one example embodiment, the initiator leads 128 are coupled with a current source (e.g., a capacitor). The transmission of current from the capacitor through the initiator leads 128 detonates an explosive charge 104 within the casing 102.

It should be noted that the initiator leads 128 may be any shape and/or size that facilitates transmitting current. In some embodiments, the casing 102 is at least partially formed of a conductive material that provides an electrical connection with what is inside the casing 102.

The explosive charge 104 is configured to initiate and detonate an explosive payload within the explosive delivery device. It should be noted that the explosive charge 104 may be detonated by any suitable method.

The casing 102 may include a number of components that are sized and shaped to fit within the casing 102. The type and size of the components within the casing 102 will depend in part on the type of system where the initiator housing assembly will be used and the type of initiator that is used in the system.

In the example embodiment illustrated in FIG. 1, the casing 102 includes a diaphragm 105 that dampens shock to the initiator support assembly 100 when the diaphragm 105 is mounted against a structure S that transfers shock to the initiator support assembly 100. During impact and penetration of a system that includes the initiator support assembly 100, the initiator support assembly 100 is exposed to rapid deceleration, acceleration, rebounding and movement of component pieces (among other things). The diaphragm 105 of the casing 102 may partially serve to alleviate the shock that is generated by these types of things during impact and penetration of a projectile that includes the initiator support assembly 100.

The diaphragm 105 of the casing 102 allows the majority of the casing 102 to be isolated from a shock transferring structure S by the diaphragm 105. The diaphragm 105 may absorb some of the shock that would otherwise be transferred from the structure S to the rest of the casing 102.

In some embodiments, the diaphragm 105 is thinner than the rest of casing 102. As an example, the diaphragm may be less than 0.10 inches thick. In addition, the diaphragm 105 may be formed of stainless steel, and the casing may be formed of a hermetic material. In other embodiments, the diaphragm 105 may be formed of multiple layers. As an example, one of the multiple layers may be metal and another of the multiple layers may be plastic. It should be noted that the diaphragm 105 may be mounted to the structure S by any suitable method (e.g., welding, fasteners and/or adhesives).

Figure 2:
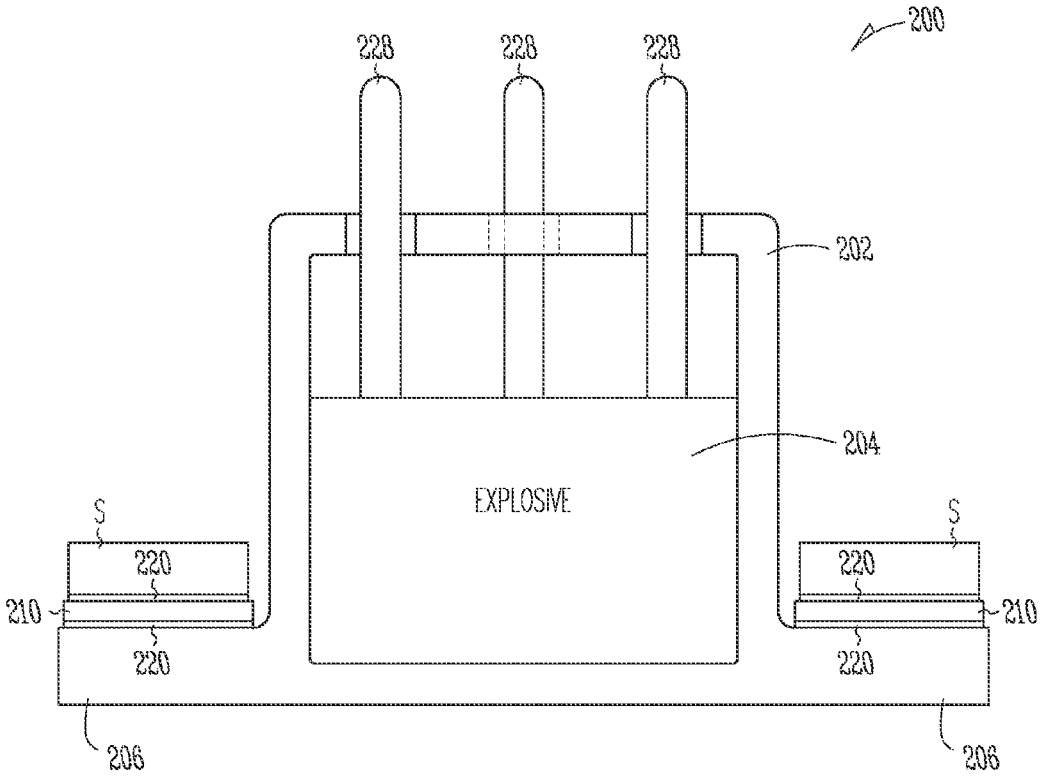
FIG. 2 is a schematic cross section view of an initiator support assembly in accordance with another example embodiment.

FIG. 2 shows another example initiator support assembly 200. The initiator support assembly 200 includes a casing 202, and one or more initiator leads 228 extending from the casing 202. The transmission of current through the initiator leads 228 detonates an explosive charge 204 within the casing 202.

In the example embodiment illustrated in FIG. 2, the casing 202 includes a flange 206 and a dampening member 210 attached to the flange 206. The dampening member 210 is between the flange 206 and a structure S where the initiator support assembly 200 is mounted. The dampening member 210 dampens shock that would otherwise be transferred from the structure S to initiator support assembly 200 when the flange 206 is mounted to the structure S.

In some embodiments, the casing 202 may be formed of stainless steel, and/or the dampening member 210 may be formed of plastic. In other embodiments, the dampening member 210 may be formed of multiple layers. As an example, one of the multiple layers may be metal, and another of the multiple layers may be plastic. Although the flange 206 is shown as being the same size as the rest of casing 202, it should be noted that the flange 202 may be different in thickness than the rest of casing 202.

In some embodiments, the dampening member 210 is a bonding material. In other embodiments, at least one bonding material 220 is used to secure the dampening member 210 to the structure S flange 202.

Figure 3:
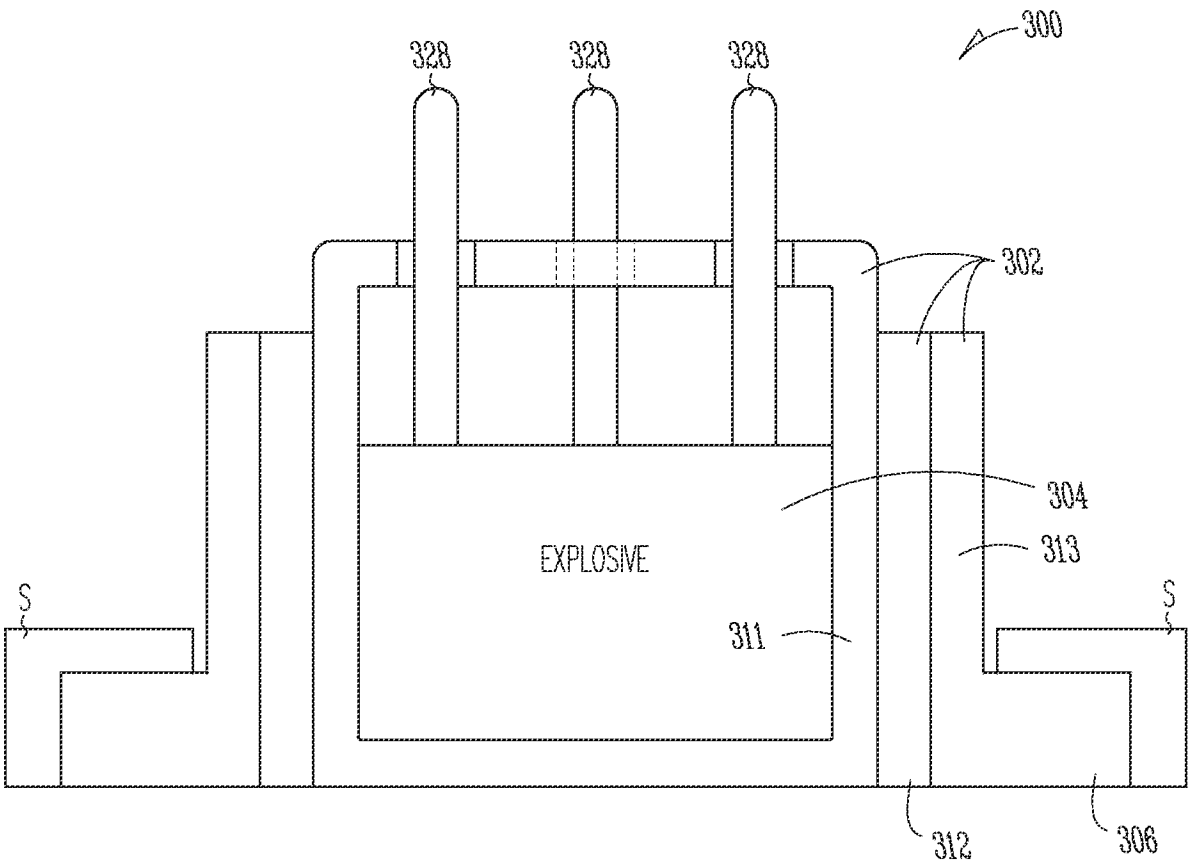
FIG. 3 is a schematic cross section view of an initiator support assembly in accordance with still another example embodiment.

FIG. 3 shows another example initiator support assembly 300. The initiator support assembly 300 includes a casing 302 and one or more initiator leads 328 extending from the casing 302. The transmission of current through the initiator leads 328 detonates an explosive charge 304 within the casing 302.

In the example embodiment illustrated in FIG. 3, at least a portion of the casing 302 is formed of an interior wall 311, a dampening layer 312 covering at least a portion of interior wall 311 and an exterior wall 313. The dampening layer 312 dampens shock to the initiator support assembly 300 that would otherwise be transferred from a structure S to the initiator support assembly 300 when the exterior wall 313 is mounted to the structure S.

In some embodiments, the exterior wall 313 includes a flange 306 that is adapted to be attached to the support structure S in some form. In addition, the exterior wall 313 may be thinner than the interior wall 311.

The interior wall 311 may include grooves (or some form of surface roughening) to facilitate bonding with the dampening layer 312. In addition, the exterior wall 313 may include grooves (or some form of surface roughening) to facilitate bonding with the dampening layer 312.

In some embodiments, the dampening layer 312 may be formed of multiple layers. As an example, any of the multiple layers may be metal, plastic or formed of a bonding material. In addition, the dampening layer 312 may also provide an environmental seal.

As discussed above, the casings in the initiator support assemblies described herein may be constructed to include a plurality of components. After assembly of the components within the casing, the casing may be closed (e.g., with an end cap). The components may be compressed to tightly engage each other and minimize movement of the components relative to each other when the initiator support assemblies are exposed to a dynamic environment (e.g., striking and penetrating a target). In other embodiments, the components may be adhered to each other and/or the casing by adhesives applied along the inner wall of the casing.

Figure 4:
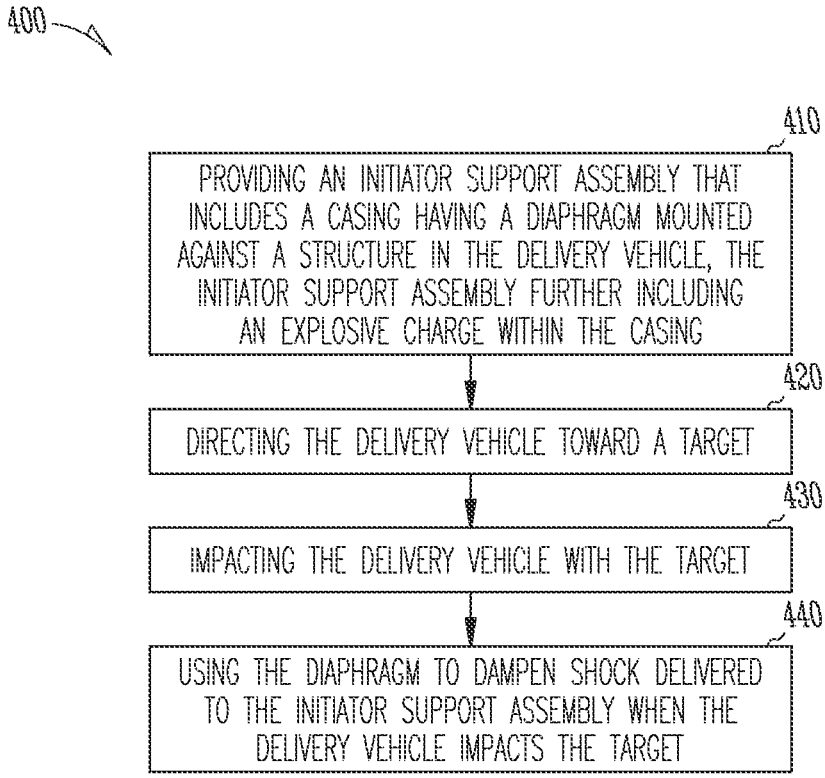
FIG. 4 is a flow diagram illustrating an example method for dampening shock delivered to an initiator support assembly within a delivery vehicle in accordance with one example embodiment.

FIG. 4 is a flow diagram illustrating an example method for dampening shock delivered to an initiator support assembly 100 within a delivery vehicle, in accordance with one example embodiment. As shown in box 410, the method 400 includes providing an initiator support assembly 100 that includes a casing 102 having a diaphragm 105 mounted against a structure S in the delivery vehicle where the initiator support assembly 100 further includes an explosive charge 104 within the casing 102.

As shown in box 420, the method further includes directing the delivery vehicle toward a target (not shown in Figures). As shown in box 430, the method further includes impacting the delivery vehicle with the target. As shown in box 440, the method further includes using the diaphragm 105 to dampen shock delivered to the initiator support assembly 100 when the delivery vehicle impacts the target.

In some embodiments, providing an initiator support assembly 100 that includes a casing 102 having a diaphragm 105 includes providing a diaphragm 105 formed of multiple layers. In addition, providing an initiator support assembly 100 that includes a casing 102 having a diaphragm 105 may include providing a diaphragm 105 that is thinner than the rest of the casing 102.

Figure 5:
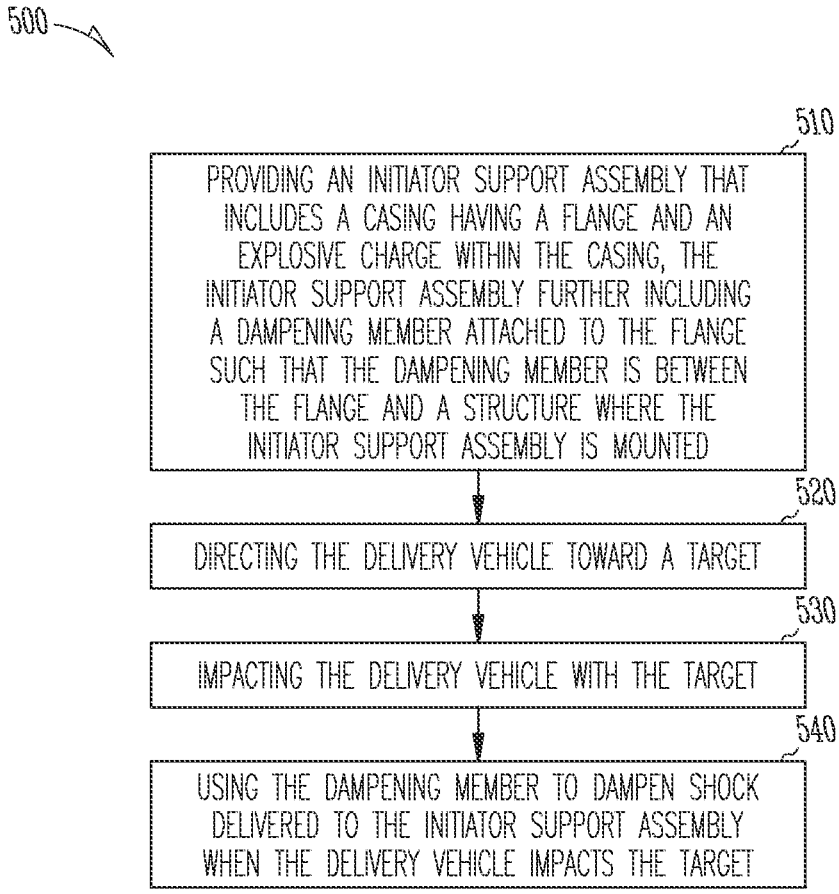
FIG. 5 is a flow diagram illustrating an example method for dampening shock delivered to an initiator support assembly within a delivery vehicle in accordance with another example embodiment.

FIG. 5 is a flow diagram illustrating an example method for dampening shock delivered to an initiator support assembly 200 within a delivery vehicle in accordance with another example embodiment. As shown in box 510, the method 500 includes providing an initiator support assembly 200 that includes a casing 202 having a flange 206 and an explosive charge 204 within the casing 202. The initiator support assembly 200 further includes a dampening member 210 attached to the flange 206 such that the dampening member 210 is between the flange 206 and a structure S where the initiator support assembly 200 is mounted.

As shown in box 520, the method further includes directing the delivery vehicle toward a target (not shown in Figures). As shown in box 530, the method further includes impacting the delivery vehicle with the target. As shown in box 540, the method further includes using the dampening member 210 to dampen shock delivered to the initiator support assembly 200 when the delivery vehicle impacts the target.

In some embodiments, providing an initiator support assembly 200 that includes a dampening member 210 includes providing a dampening member 210 formed of multiple layers. As an example, one of the multiple layers may be metal and another of the multiple layers may be plastic. In addition, providing an initiator support assembly 200 that includes a casing 202 having a flange 206 may include providing a casing 202 where the flange 206 is the same thickness as the rest of the casing 202.

Figure 6:
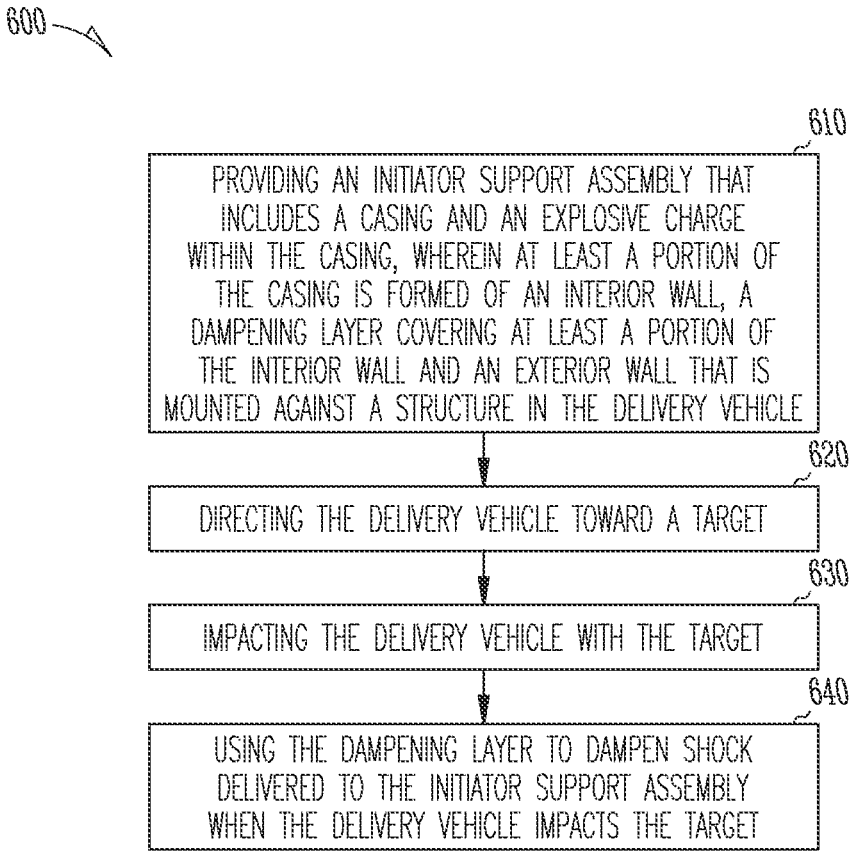
FIG. 6 is a flow diagram illustrating an example method for dampening shock delivered to an initiator support assembly within a delivery vehicle in accordance with still another example embodiment.

FIG. 6 is a flow diagram illustrating an example method for dampening shock delivered to an initiator support assembly 300 within a delivery vehicle in accordance with still another example embodiment. As shown in box 610, the method 600 includes providing an initiator support assembly 300 that includes a casing 302 and an explosive charge 304 within the casing 302. At least a portion of the casing 302 is formed of an interior wall 311 and a dampening layer 312 covering at least a portion of the interior wall 311. The casing 302 further includes an exterior wall 313 that is mounted against a structure S in the delivery vehicle.

As shown in box 620, the method further includes directing the delivery vehicle toward a target (not shown in Figures). As shown in box 630, the method further includes impacting the delivery vehicle with the target. As shown in box 640, the method further includes using the dampening layer 312 to dampen shock delivered to the initiator support assembly 300 when the delivery vehicle impacts the target.

In some embodiments, providing an initiator support assembly 300 that includes an interior wall 311 and an exterior wall 313 includes providing an exterior wall 313 that includes a flange 306 where the exterior wall 313 is thinner than the interior wall 311. In addition, providing a casing 302 formed of an interior wall 311, a dampening layer 312 and an exterior wall 313 may include providing an interior wall 311 that includes grooves (or some form of surface roughening) to facilitate bonding with the dampening layer 312, and/or providing an exterior wall 313 that includes grooves (or some form of surface roughening) to facilitate bonding with the dampening layer 312.

CONCLUSION

The initiator support assemblies and methods described herein provide shock dampening for the explosive charge. The shock dampening may help to prevent premature fracture of the explosive charge during impact and penetration of an explosive delivery device with a target.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. An initiator support assembly comprising:

a casing that includes a diaphragm which forms at least part of the casing;

an explosive charge positioned within the casing, wherein the casing and the diaphragm enclose the explosive charge; and wherein the diaphragm dampens shock to the initiator support assembly when the diaphragm is mounted against a structure.

2. The initiator support assembly of claim 1, wherein the diaphragm is formed of multiple layers.

3. The initiator support assembly of claim 1, wherein the diaphragm is thinner than the rest of the casing.

4. The initiator support assembly of claim 1, wherein the diaphragm is less than 0.10 inches thick.

5. The initiator support assembly of claim 1, wherein the diaphragm is formed of stainless steel.

6. The initiator support assembly of claim 1, wherein the casing is formed of a hermetic material.

* * * * *